United States Patent [19]

Bruening

[11] 4,353,477

[45] Oct. 12, 1982

[54] FLOATING ROOF METALLIC SHOE SECONDARY SEAL

[75] Inventor: Robert A. Bruening, Naperville, Ill.

[73] Assignee: Chicago Bridge & Iron Company, Oak Brook, Ill.

[21] Appl. No.: 838,051

[22] Filed: Sep. 30, 1977

[51] Int. Cl.[3] ..... B65D 88/46

[52] U.S. Cl. ..... 220/224; 220/222

[58] Field of Search ..... 220/224, 216, 221, 222

[56] References Cited

U.S. PATENT DOCUMENTS

| | | | |
|---|---|---|---|
| 1,900,904 | 3/1933 | Berger | 220/224 X |
| 3,185,335 | 5/1965 | Lecler | 220/222 |
| 3,204,809 | 9/1965 | Cadwell | 220/222 |
| 3,618,812 | 11/1971 | Maeder et al. | 220/222 X |
| 3,900,127 | 8/1975 | Schwarz | 220/216 |
| 3,942,674 | 3/1976 | Nelson | 220/221 |

*Primary Examiner*—Steven M. Pollard

*Attorney, Agent, or Firm*—Merriam, Marshall & Bicknell

[57] ABSTRACT

In a liquid storage tank having a floating roof, a plurality of shoes adapted to slidably contact the inner side wall of the tank, and means supported by the roof for pressing the shoes against the inner side wall, and a fabric vapor barrier extending from the roof to the shoes, the improvement comprising: an elastomeric strip, impermeable to vapor, in the form of an annulus connected at its bottom edge portion by an essentially vapor tight joint to the top circumference of the roof and with its top edge portion in movable sealing contact with the tank inner side wall above the top of the shoes, said strip being arced upwardly from the roof and movably supported intermediate its bottom and top edges by support means, mounted on the upper portion of the shoes, in contact with the lower surface of the elastomeric strip.

2 Claims, 6 Drawing Figures

FLOATING ROOF METALLIC SHOE SECONDARY SEAL

This invention relates to an improvement in floating roof tanks used for the storage of petroleum products or other volatile liquid materials, and in particular relates to an improved seal for a floating roof.

In a conventional floating roof tank, there is provided a clearance space or rim space between the tank side wall and the vertical rim of the roof. This space is necessary to provide clearance to permit unrestrained vertical travel of the roof within the tank. The clearance space is of sufficient size that local dimensional variations in the circularity and straightness of the tank sidewall or shell, which can result from uneven foundation settlement, imprecise fabrication or erection or unusual live loads such as high winds and the like, do not hamper vertical travel of the roof.

To maintain the roof centered in the tank and to effect a seal against evaporation loss, it is conventional to use a plurality of vertical shoes adapted to slidably contact the entire circular inner side wall of the tank and means supported by the roof for pressing the shoes against the inner side wall, as well as to support the shoes. Vapor loss through the clearance space is prevented by a flexible nonpermeable fabric barrier which extends from the upper part of the shoes to the floating roof top edge. Such structures are disclosed in many U.S. Pat. Nos. including Nos. 2,587,508; 2,611,504; 2,630,937; 2,649,985 and 2,696,930.

The described primary seal system has been proven over many years use to be highly effective. However, the increasingly more stringent environmental protection rules make it desirable to provide a secondary seal system so as to further prevent, or minimize, vapor escape from between the shoes and the inner side wall of the tank. This is especially desirable when considering tank shells of riveted construction and the associated protrusions caused by laps and rivet heads at the joints.

According to the present invention, there is provided an improved liquid storage tank having a floating roof, a plurality of shoes adapted to slidably contact the inner side wall of the tank, means supported by the roof for pressing the shoes against the inner side wall and a fabric vapor barrier extending from the roof to the shoes, in which the improvement comprises an elastomeric strip, impermeable to vapor, in the form of an annulus connected at its bottom edge portion by an essentially vapor tight joint to the top circumference of the roof and with its top edge portion in movable sealing contact with the tank inner side wall above the top of the shoes, said strip being arced upwardly from the roof and movably supported intermediate its bottom and top edges by support means, mounted on the upper portion of the shoes, in contact with the lower surface of the elastomeric strip. The support means and lower surface of the elastomeric strip can be in slidable contact or in rolling contact. Also, the support means can be an integral extension of the shoes or the support means can be an attachment to the top portion of the shoes. Desirably, the support means has an inclined surface in contact with the strip.

The invention will be described further in conjunction with the attached drawings, in which.

So far as is practical the same elements or parts which appear in the various figures of the drawings will be illustrated by the same numbers.

Figure 1:
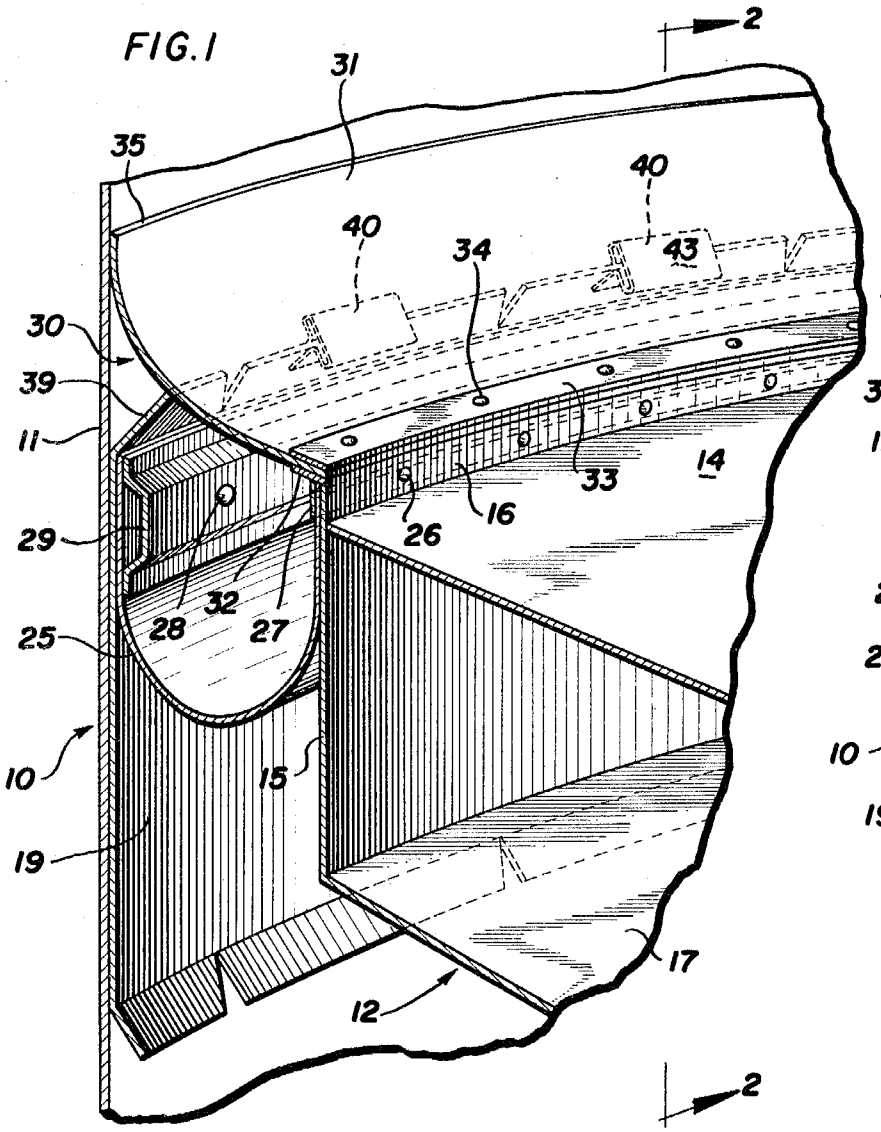
FIG. 1 is an isometric, partial sectional view through a liquid storage tank showing the tank side wall, a floating roof and shoes, and one embodiment of a secondary seal employing an elastomeric strip mounted at the top circumference of the shoes and supported by a plurality of clips.

Referring to FIG. 1, liquid storage tank 10 has a side wall 11 and a floating roof 12. The floating roof 12 has a top 14, a side 15 terminating in an upper vertical rim 16 and a bottom 17. The shoes 19 are suspended in surface-to-surface contact with the tank side wall 11 by a well known hanger-pusher mechanism (partially shown as 20 in FIGS. 2 and 4) such as a weighted pantagraph. The shoes 19 are constructed of flexible metal sheets and are provided with vertical spaced-apart flexures in the form of a U-shaped corrugation (see U.S. Pat. No. 2,611,504). The roof 12 floats on liquid in the tank and rises and falls as the level of the liquid is raised or lowered, during which movement the shoes contact the side wall of the tank. Flexible sheet material vapor barrier 25 is connected at its inner edge by bolts 26 and metal band 27 to roof rim or edge 16. The upper or outer edge of vapor barrier 25 is connected to the upper portion of shoes 19 by means of bolts 28 and metal band 29. The shoes 19 and the vapor barrier 25 constitute a primary seal of previously known construction.

The improved liquid storage tank according to the invention has a primary seal, such as described although other known primary seals can be used, and a secondary seal 30 which reduces vapor loss from a liquid stored in the tank. The secondary seal shown in FIGS. 1 and 2 includes an upwardly arced elastomeric strip 31 having its bottom edge joined to horizontal flange 32, on the top of roof rim 16, by a retaining band 33 and bolts 34 thereby completing a vapor tight connection or seal. The upper edge 35 of strip 31 is kept in contact with the tank wall inner surface by gravity acting on the strip and by its flexible and elastomeric character. A rubber web, with or without internal fabric reinforcing, can be used for the strip. The strip when joined to the roof as described extends completely around the circumference or periphery of the roof and thus forms an annulus.

To prevent the strip 31 from folding backwardly or downwardly through vertical reciprocal displacement of the roof caused by removing and supplying liquid to the tank, or by action of the wind, or snow and ice, and a resulting loss of the desired vapor tight seal, the strip 31 is supported by a series of metal clips 40 pushed onto the inwardly slanted or inclined top portions 39 of shoes 19. The clips 40 in lateral section are of a T-shape having two vertical legs 41 and 42, which clamp onto the top portions 39 of the shoes by spring action. Each clip 40 has a downwardly sloped surface 43 which supports strip 31 intermediate its bottom and top edges yet permits the strip bottom surface to slide thereon when the roof moves radially in the tank. A plurality of clips 40 is positioned on the shoes completely around the roof in sufficient number to support strip 31 and prevent it from doubling back from up and down movement of the roof.

Figure 3:
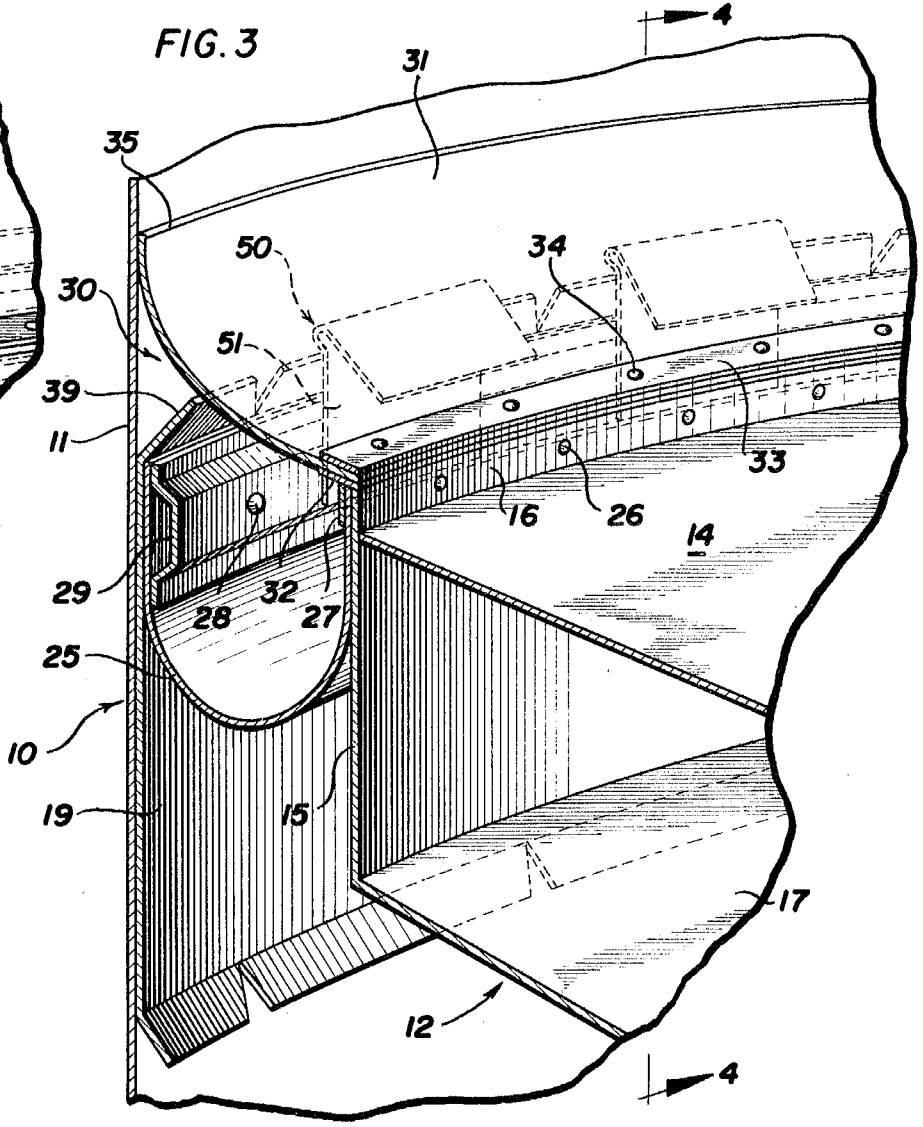
FIG. 3 is an isometric view, like FIG. 1, showing a second embodiment of support means for the elastomeric strip.
Figure 4:
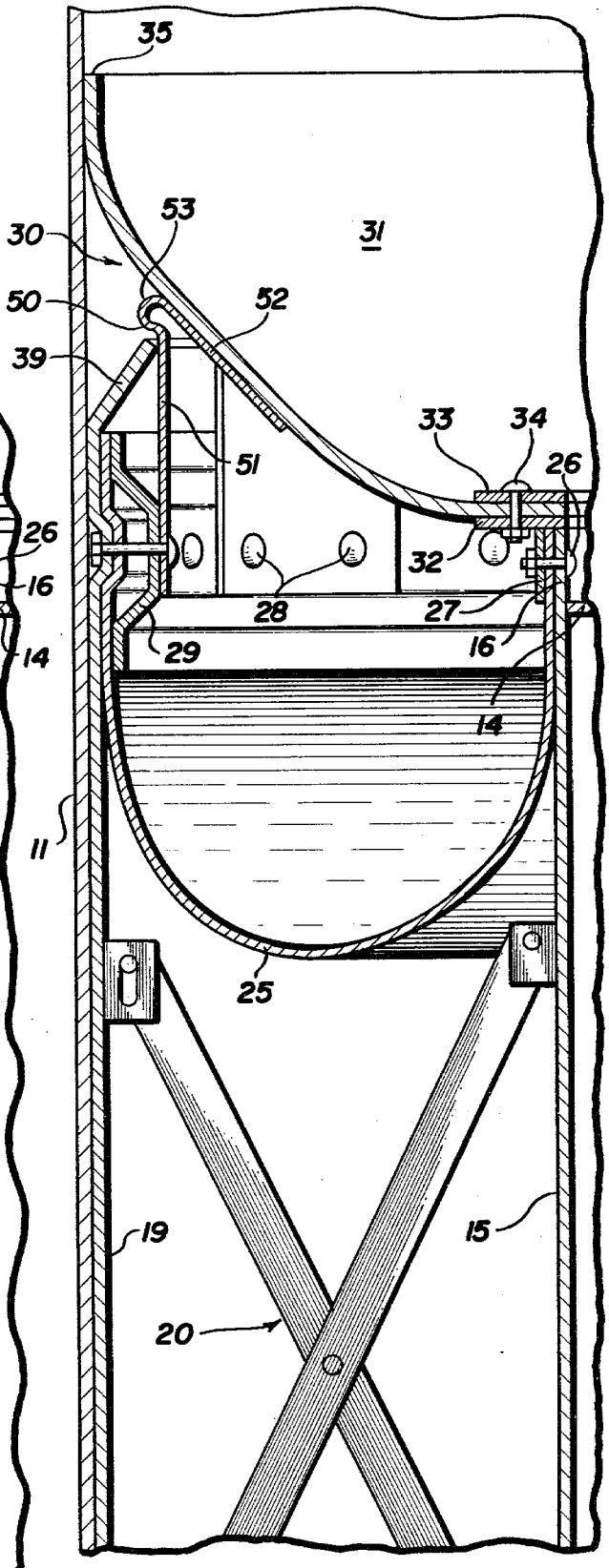
FIG. 4 is a sectional view taken along the line 4—4 of FIG. 3.

A second embodiment of the invention is illustrated by FIGS. 3 and 4. In this embodiment the strip 31 of secondary seal 30 is supported by a plurality of spaced-apart brackets 50 positioned on metal band 29. Each bracket is held in place by bolts 28 which extend through holes in vertical wall 51 of each bracket 50. Downwardly inclined top 52 is integrally joined to wall 51 by a loop 53 which permits the top 52 to pivot or rotate in a spring like manner if needed to adjust to contact with the bottom surface of strip 31. Strip 31 is thereby supported to freely slide on bracket tops 52 when there is radial or sideward displacement of the roof without loss of sealing contact between the tank inner surface and the strip end 35.

Figure 2:
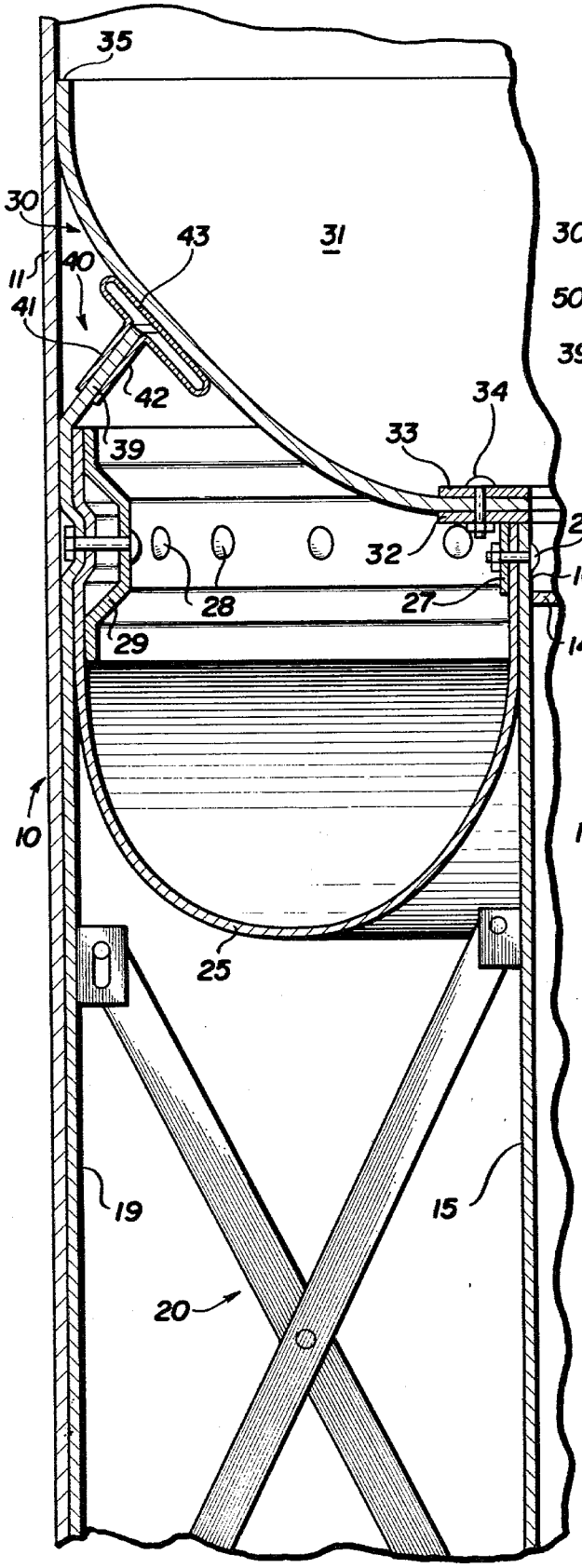
FIG. 2 is a sectional view taken along the line 2—2 of FIG. 1.

The clip 40 shown in FIGS. 1 and 2, and the bracket 50 shown in FIGS. 3 and 4, can be used to retrofit tanks now in commercial use or they can be used on new tanks.

Figure 5:
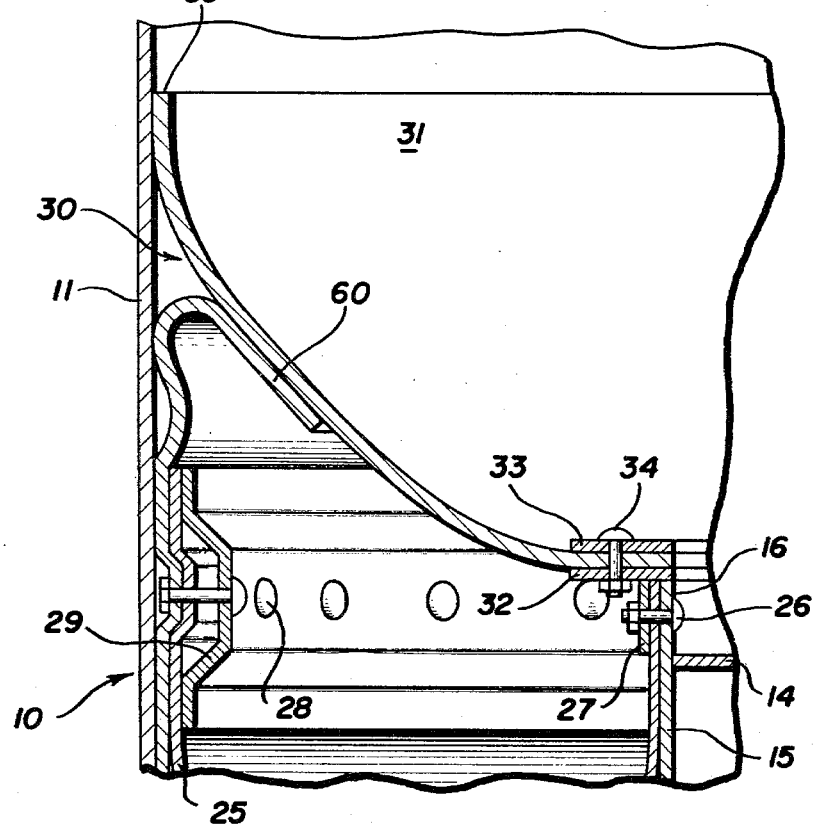
FIG. 5 is a sectional view like FIG. 4 but with the elastomeric strip support means integrally formed in the shoes.

A third embodiment of the invention is illustrated by FIG. 5. In this embodiment the strip 31 is movably supported by a plurality of downwardly sloped spaced-apart flanges 60 integrally formed on the top of the shoes 19. This embodiment is considered more suitable for use on new tanks than in retrofitting old tanks since its use would involve more labor and investment than use of either of the first two embodiments in retrofitting old tanks.

Figure 6:
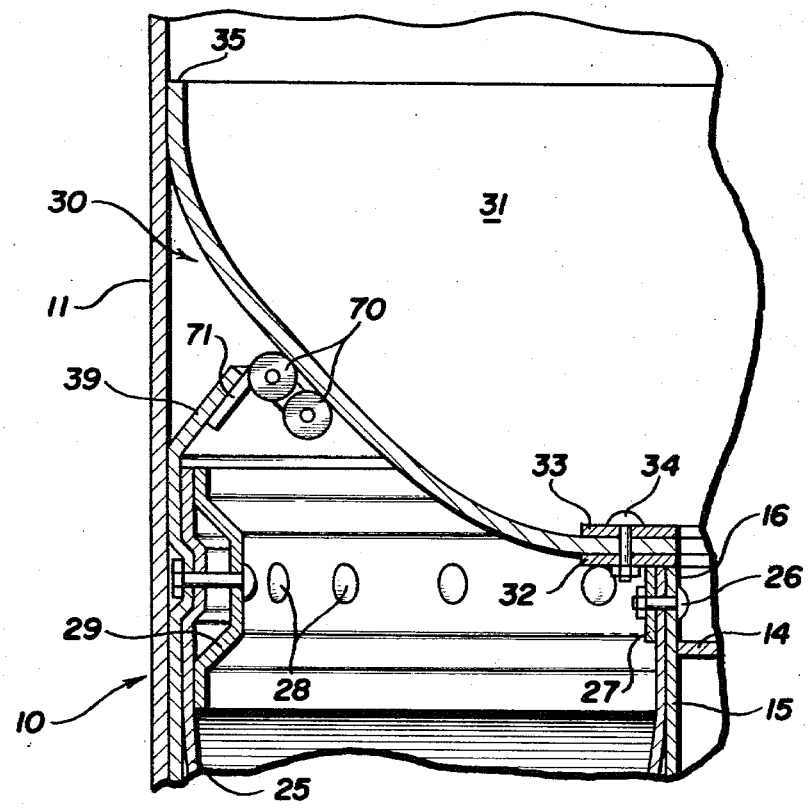
FIG. 6 is a sectional view like FIG. 4 but with rollers supporting the elastomeric strip.

Instead of the support for the strip 31 having inclined surfaces such as 43, 52 and 60, rollers 70 could be used as shown in FIG. 6. The horizontal rollers 70 could be about 3 to 12 inches long and spaced-apart at their ends from adjoining rollers. Nylon, polypropylene or stainless steel tubing with closed ends for axles could be used for the rollers. Brackets 71, mounted on the top of shoes 19, could be used to hold the roller axles in place.

The foregoing detailed description has been given for clearness of understanding only and no unnecessary limitations should be understood therefrom as modifications will be obvious to those skilled in the art.

What is claimed is:

1. In a liquid storage tank having a floating roof, a plurality of shoes adapted to slidably contact the inner side wall of the tank, and means supported by the roof for pressing the shoes against the inner side wall, and a fabric vapor barrier extending from the roof to the shoes, the improvement comprising:

an elastomeric strip, impermeable to vapor, in the form of an annulus connected at its bottom edge portion by an essentially vapor tight joint to the top circumference of the roof and with its top edge portion in movable sealing contact with the tank inner wall above the top of the shoes, said strip being arced upwardly from the roof and supported intermediate its bottom and top edges by support means, mounted on the upper portion of the shoes, in contact with the lower surface of the elastomeric strip, the support means and lower surface of the elastomeric strip being in slidable contact with each other, and the support means is a T-shaped clip attachment having two legs which receive a shoe top edge therebetween.

2. In a liquid storage tank having a floating roof, a plurality of shoes adapted to slidably contact the inner side wall of the tank, and means supported by the roof for pressing the shoes against the inner side wall, and a fabric vapor barrier extending from the roof to the shoes, the improvement comprising:

an elastomeric strip, impermeable to vapor, in the form of an annulus connected at its bottom edge portion by an essentially vapor tight joint to the top circumference of the roof and with its top edge portion in movable sealing contact with the tank inner side wall above the top of the shoes, said strip being arced upwardly from the roof and supported intermediate its bottom and top edges by support means, mounted on the upper portion of the shoes, in contact with the lower surface of the elastomeric strip and with the strip separately and independently movable with respect to the support means, and the support means including horizontal rollers in contact with the lower surface of the elastomeric strip.

* * * * *